United States Patent [19]

Lytle

[11] 4,293,079

[45] Oct. 6, 1981

[54] HINGED CLOSURE

[75] Inventor: Thomas G. Lytle, Norwalk, Conn.

[73] Assignee: TLB Plastics Corporation, Brewster, N.Y.

[21] Appl. No.: 133,623

[22] Filed: Mar. 24, 1980

[51] Int. Cl.[3] ..... B65D 41/16; B65D 41/18

[52] U.S. Cl. ..... 220/306; 220/307; 220/334; 220/339

[58] Field of Search ..... 220/253, 254, 300, 334, 220/339, 306, 307; 222/151, 543, 546, 565; 206/538

[56] References Cited

U.S. PATENT DOCUMENTS

| | | | |
|---|---|---|---|
| 3,874,580 | 4/1975 | Weathhead | 220/253 X |
| 4,106,672 | 8/1978 | Tecco et al. | 220/339 X |
| 4,163,496 | 8/1979 | Dogliotti | 220/306 X |
| 4,170,315 | 10/1979 | Dubrach et al. | 220/339 X |

*Primary Examiner*—George T. Hall

*Attorney, Agent, or Firm*—Howard C. Miskin

[57] ABSTRACT

A receptacle includes a square tubular plastic body member closed at its bottom and open at its top and having formed in the corners of its upper border inwardly projecting locking barbs provided with downwardly inwardly inclined upper cam surfaces and bottom horizontal locking edges. An integrally formed closure assembly includes a square frame having a depending skirt wall telescoping the body member top border and having recesses formed in its corners receiving corresponding barbs and having bottom shoulders engaging the barb bottom edges, the frame having a top peripheral flange abutting the body member top edges. A lid is self hinged to the frame and includes a skirt wall engaging the frame flange in the lid closed position and depending corner elements engaging the frame corner recesses. Cooperating latching elements are provided at the free edges of the frame and lid.

10 Claims, 8 Drawing Figures

HINGED CLOSURE

BACKGROUND OF THE INVENTION

The present invention relates generally to improvements in receptacles more particularly to an improved storage container having intercoupled separate body member and closure assembly.

In the packaging of many products, particularly products of elongated dimensions such as umbrellas, rolled documents such as prints, maps, drawings, blueprints and the like, for storage, shipping and handling it is a common practice to employ an elongated receptacle which is closed at one end and provided with a closure member at the other end. A friction slide on cover or cap is usually employed as a cover member but such expedient posessed among the other drawbacks, that the cap would be released from the body member and open the receptalce under the weight of the contained product when the receptacle was handled particulary when such product was heavy. Moreover the closure cap was of generally greater transverse dimensions than the body member so as to create additional storage and shipping problems. An alternative structure included an internal insert permanently fastened to the upper part of the body member to which the closure member is mounted. However, this structure normally required punching, resulting in openings which allowed the free access of dust and moisture to the package with consequent drawbacks. Thus the receptacles of the present nature heretofore available or proposed are unreliable and of little adaptability and otherwise leave much to be desired.

SUMMARY OF THE INVENTION

It is a principal object of the present invention is to provide an improved receptacle.

Another object of the present invention is to provide an improved receptacle for the storage, shipping, dispensing, exhibition and handling of relatively long products.

Still another object of the present invention is to provide an improved elongated packaging receptacle provided with a closure member which is easily transferred between its open and closed positions and is reliably releasably retained in its closed position.

A further object of the present invention is to provide an improved receptacle closure assembly which is easily reliably attached to a receptacle body member.

Still a further object of the present invention is to provide a device of the above nature characterized by its reliability, simplicity, ruggedness, low cost, attractive appearance and great versitility and adaptability.

The above and other objects of the present invention will become apparent from a reading of the following description taken in conjunction with the accompanying drawings which illustrate a preferred embodiment thereof.

A receptacle according to the present invention includes a body member which is preferably of tubular configuration and of polygonal, circular or other transverse cross section, closed at its bottom and open at its top and having formed in its upper border perpherally spaced inwardly projecting locking elements which in the case of the polygonal shape, are preferably located at the corners of the body member. A closure assembly includes a frame member corresponding in shape to and telescoping the body member upper border and having recesses registering with respective locking elements with the recess bottom faces engaging the bottoms of the locking elements. A cover member is self hinged to the frame member.

In accordance with a preferred embodiment of the present invention the body member is an extruded thermoplastic and is of square transverse cross section with the locking elements being formed at the corners thereof and being of approximately a pyramidal or coffee spout shape with a downwardly inwardly tapering cam defining surface terminating in a horizontal edge delineating a bottom opening. The closure assembly comprises a square coupling frame which telescopes the top of the body member and has a top peripheral flange engaging the body member top edge and open topped corner recesses with upwardly outwardly inclined bottom shoulders engaging the bottom edges of respective locking elements. A square lid with a skirt wall is self hinged to a side of the frame and has depending corner extensions which separably engage the frame corner recesses in the lid closed position and is releasably locked in closed position by a latch member.

The improved receptacle is simple and inexpensive, easy to assemble, compact, highly reliable and of great versitility and adaptability.

DESCRIPTION OF THE PREFERRED EMBODIMENT

Figure 1:
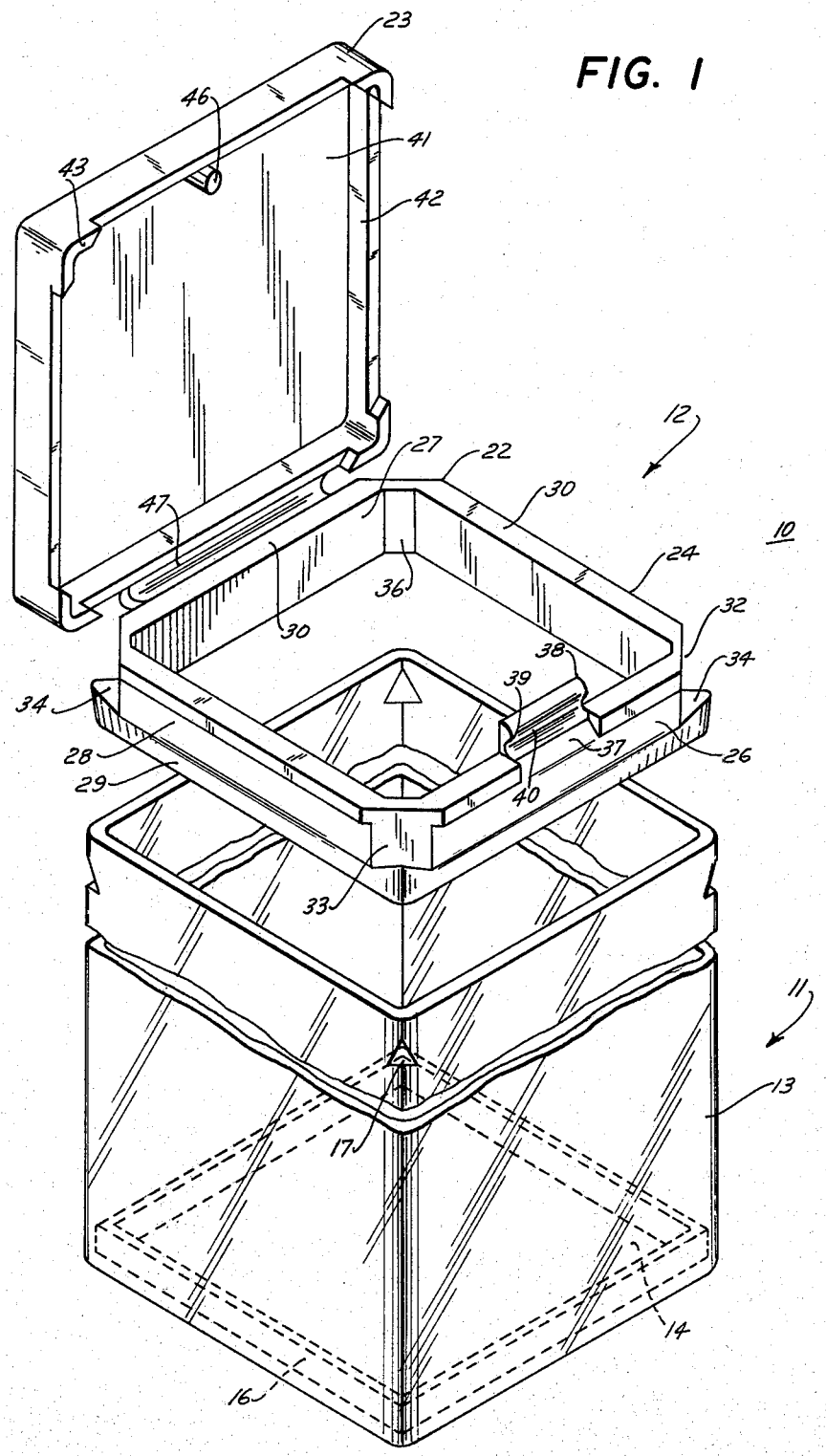
FIG. 1 is an exploded perspective view, partially foreshortened, of a receptacle embodying the present invention, shown in an open condition.
Figure 2:
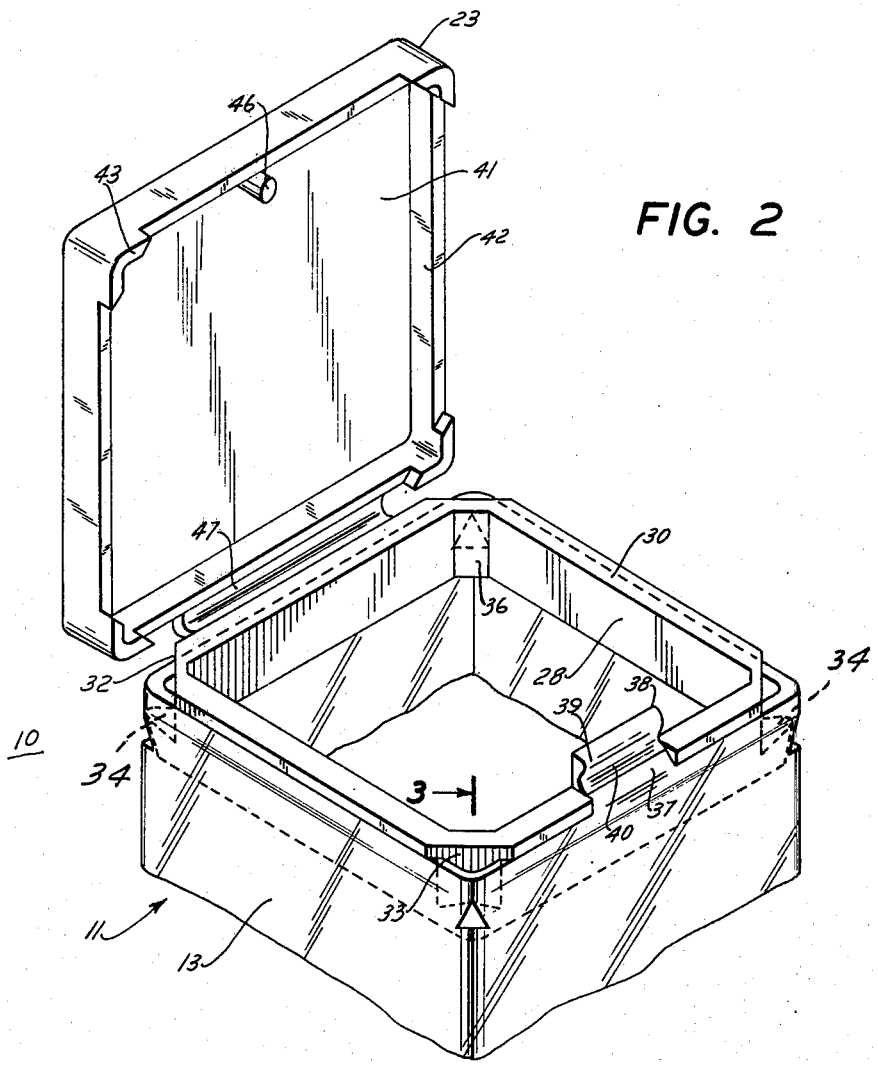
FIG. 2 is a partial perspective view thereof in an open assembled condition.
Figure 3:
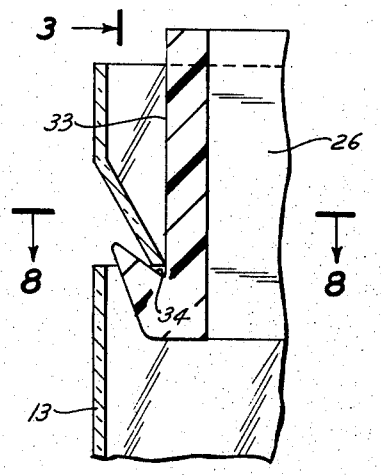
FIG. 3 is an enlarged sectional view taken along line 3—3 in FIG. 2.
Figure 4:
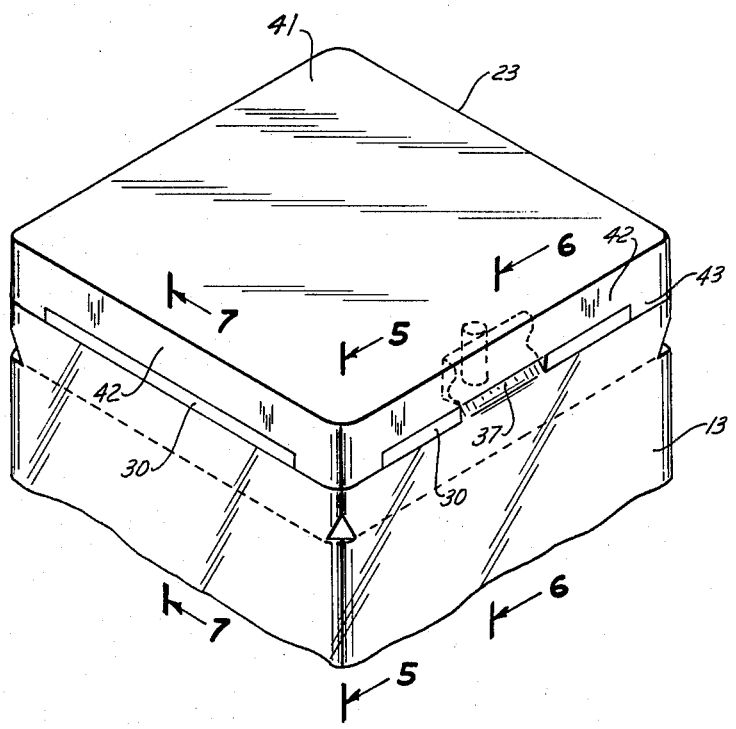
FIG. 4 is a view similar to FIG. 2 but showing the receptacle in closed condition.
Figure 5:
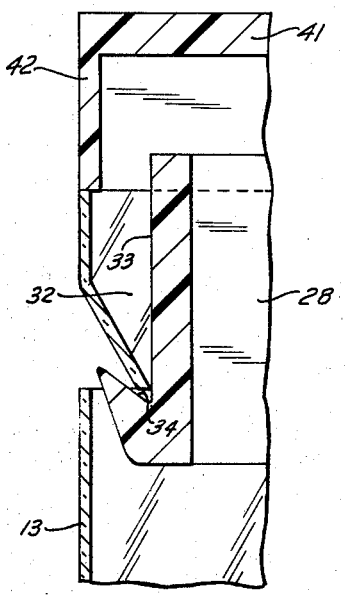
FIG. 5 is an enlarged sectional view taken along line 5—5 in FIG. 4.
Figure 6:
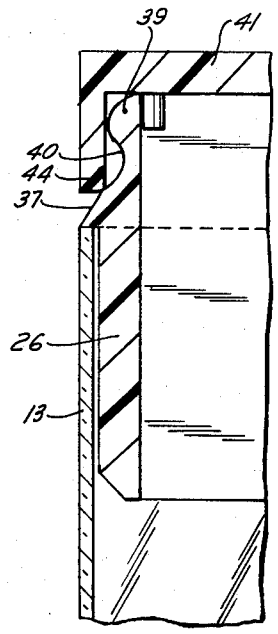
FIG. 6 is an enlarged sectional view taken along line 6—6 in FIG. 4.
Figure 7:
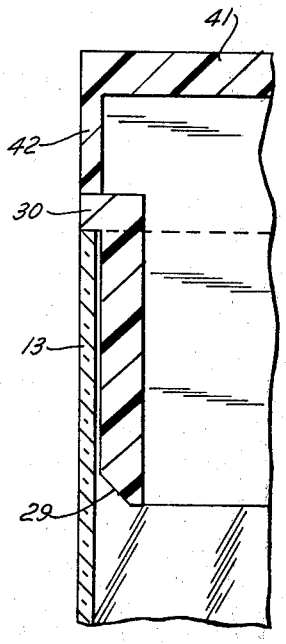
FIG. 7 is an enlarged sectional view taken along line 7—7 in FIG. 4.
Figure 8:
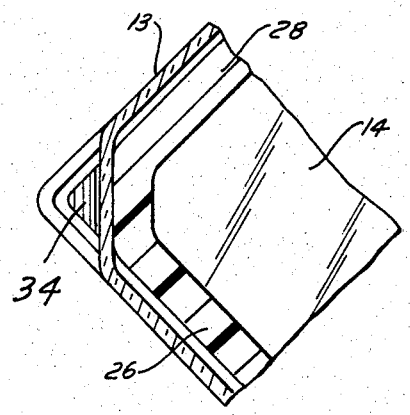
FIG. 8 is a sectional view taken along line 8—8 in FIG. 3.

Referring now to the drawings which illustrate a preferred embodiment of the present invention the reference numeral 10 generally designates the improved receptacle which includes a main body member 11 and a closure and coupling assembly 12 which are joined in the manner hereinafter described.

The body member 11 includes a tubular elongated peripheral wall 13 which is illustrated as being of square transverse cross section it being understood that it may be of rectangular triangular hexagonal or other polygonal transverse cross section or of circular or other desired cross section. The body member 11 is open at its top and suitably closed at its bottom by a square bottom end wall 14 provided with an integrally formed upstanding peripheral wall 16 telescoping the bottom border of peripheral wall 13 and firmly affixed thereto such as by fusing or cementing. The peripheral wall 13 is advantageously formed by extrusion of a thermoplastic synthetic organic polymeric resin composition which is resilient and flexible and which may be transparent, translucent or opaque, of clear or of any desired color and may be decorated and bear information as desired.

Formed in each corner of the upper border of peripheral wall 13 and integral therewith is an inwarldy projecting outwardly resiliently flexible locking barb or element 17 of inverted open bottomed spout shape configuration, the tabs 17 being positioned at the same level in a common horizontal plane. Each locking element 17 includes a downwardly diverging roughly conical or pyramidal wall 18 formed from peripheral wall 13 and joined along its apex and side edges to peripheral wall 13. The wall 13 terminates at its bottom in a roughly triangular approximately horizontal bottom edge 19 which may be convex along its length and is rounded at its inwardly directed corner or apex and delineates a bottom opening 20. The inner inclined edge 21 of each locking element 17 is likewise rounded and defines a cam face or edge.

The closure and coupling assembly 12 includes a coupling member 22 and a closure member 23 which are formed as an integral unit preferably by injection molding of a thermoplastic synthetic organic polymeric resin composition such as a polyolefin or the like, for example polypropylene. The coupling member 22 comprises a square frame 24 including vertical front and rear walls 26 and 27 and side walls 28 and having a peripheral outer face corresponding the inside face of the upper border of body member peripheral wall 13. The bottom borders of walls 26, 27 and 28 are inwardly downwardly beveled to form cam faces 29 and a narrow outwardly projecting peripheral flange 30 is formed along the upper edges of walls 26, 27 and 28.

The corners of the frame 24 including flange 30 are diagonally cut away from the tops to points short of the bottom thereof to produce corner recesses 32 having inwardly downwardly inclined inner diagonal faces 33 and shoulder defining inwardly downwardly inclined triangular bottom faces 34. Reinforcing gussets 36 are integrally formed at the inside corners of frame member 22 and the medial front position of the front flange 30 is recessed as at 37 and longitudinally coextensive therewith and projecting upwardly from the rear border of front flange 30 is a latching member 38 having formed along the full length of its upper border a forwardly projecting longitudinal ridge 39 below which is formed a coextensive groove 40.

The cover member 23 includes a square top wall 41 and a depending peripheral skirt wall 42 the perimeter of which is substantially equal to the perimeter of peripheral flange 30. Corner members 43 of wall thicknesses about equal to that of skirt wall 42 depend from the corners of the skirt wall 42 for a distance about equal to the thickness of flange 30. An inwardly directed ridge 44 which mates groove 40 is formed along the lower inside border of the front leg of peripheral skirt wall 42 and an abutment post 46 depends from closure member top wall 41 medial of and a short distance rearwardly thereof.

A self hinge defining relatively thin narrow web 47 extends between the lower outer edge of the rear leg of skirt wall 42 and the upper outer edge of the rear leg of flange 30 and is integrally formed therewith.

In attaching and anchoring the closure and coupling assembly 12 to the open end of the body member 11 the frame member 23 is brought into aligned coaxial registry with the body member top opening and is pressed inwardly in telescoping relationship thereto until the underface of peripheral flange 30 abuts the top edge of body member peripheral wall. During the depression of the frame member the lower corners thereof press downwardly and inwardly against the locking element cam surfaces 21 to deflect locking elements 18 outwardly and permit the downward passage of the frame corners and as the frame corners pass the locking elements bottom edges 19 the locking elements 18 reseliently return to their extended positions with the edges 19 thereof engaging the corner recess bottom faces 34 and the notches delineated thereby. The coupling and closure assembly 12 is thus coupled to the body member 12 and restricted in downward movement by flange 30 and in upward movement by shoulders 34. In the assembled condition of receptacle 10 the edges of flange 30 and the outer face of peripheral wall 13 are substantially coplanar.

The cover or closure member 23 is swingable about the rear leg of frame member 12 by way of self hinge 47 and in the closed position of cover 23 the lower edges of cover skirt walls 42 substantially engage the top faces of flanges 30 with the outer faces of skirt walls 42 being coplanar with the outer peripheray of flanges 30 and the corner member 43 engage the open tops of recesses 32 with the bottoms of the corner members 43 and the bottom face of flange 30 being coplanar and the confronting vertical end edges of flanges 30 and the corner members 43 substantially abutting. The cover 23 is releasably locked in its closed position by the engagement between ridge 39 with the mating groove in the skirt wall front leg, the engagement between latching member groove 40 and skirt wall ridge 44 and the entrapment of the latch member 38 between post 46 and the skirt wall 42 front leg. The cover 23 may be opened by inserting the operators nail into the front recess 37 below skirt wall 42 and raising the cover.

While there has been described and illustrated a preferred embodiment of the present invention it is apparent that numerous alterations, omissions and additions may be made without departing from the spirit thereof.

What is claimed is:

1. A receptacle comprising a receptacle body member including a peripeheral wall with a top border delineating an opening and having formed in said top border, a plurality of resilient, hollow open bottomed, inwardly directed locking elements each of which includes an inwardly projecting downwardly outwardly tapering wall integrally joined along its side edges to said body member border and terminating at its bottom in a horizontally extending edge, a coupling member including a frame member telescoping said body member border and having an outerface substantially corresponding to the body member border inner face and having recesses in said outer face with upwardly directed bottom faces engaging the said bottom edges of said locking elements and a closure member movable between closed and open positions in and out of closing engagement with said frame member.

2. A receptacle comprising a receptacle body member of polygonal transverse cross section and including a peripheral wall with a top border delineating an opening and having formed at the corners of said top border inwardly directed resilient locking elements having downwardly facing underfaces and downwardly inwardly inclined inner cam faces, a coupling member including a frame member of polygonal transverse cross section telescoping said body member and having an outer face substantially corresponding to the body member border inner face and having at the corners of said outer face recesses with upwardly directed bottom faces engaging the underfaces of said locking elements, and a closure member movable between closed and open positions in and out of closing engagement with said frame member.

3. The receptacle of claim 1 wherein said frame member has along its upper edge an outwardly directed peripheral flange confronting the top edge of said body member to restrict the downward movement of the said frame member.

4. The receptacle of claim 2 wherein each of said locking elements comprises an inwardly projecting downwardly outwardly tapering wall integrally joined along its side edges to said body member border and terminating at its bottom in a horizontally extending edge and each of said recess bottom faces is upwardly outwardly inclined and engages a respective locking element bottom edge.

5. The receptacle of claim 1 including a self hinge joining and integrally formed with said frame and closure members.

6. The receptacle of claim 4 including means releasably locking said closure member in closed position to said frame member.

7. A receptacle comprising a receptacle body member including a tube of polygonal transverse cross section closed at its bottom and open at its top and formed of a synthetic organic polymeric resin composition, resilient locking elements integrally formed at the corners of the upper border of said body member and having downwardly facing underfaces and downwardly inwardly inclined cam faces, a coupling member including a frame member of polygonal transverse cross section including a depending peripheral wall telescoping said body member upper border and having an outer face corresponding to the inside face of said body member top border and having in the corners of said outer face recesses with upwardly directed bottom faces engaging the underfaces of said locking elements, a closure member movable between closed and open positions in and out of closing engagement with said frame member and a self hinge integrally formed with and joining a pair of corresponding edges of said frame and closure members.

8. The receptacle of claim 7 including an outwardly projecting lip formed along the upper edge of said frame member and confronting the upper edge of said body member.

9. The receptacle of claim 8 wherein each of said recesses includes a horizontal bottom face and a vertically extending rear face and is open at its top, said closure member includes a top wall and a depending skirt wall the bottom edges of which engage the top edge of said lip in the closure member closed position and angular members depending from the corners of said skirt wall and registering with the upper parts of said recesses at the level of said lip in the closure member closed position.

10. The receptacle of claim 7 comprising a latch arm projecting medially upwardly from and integrally formed with a side of said frame opposite to said hinge and including an outwardly projecting tooth engaging the inside face of a side of said closure member skirt wall remote from said hinge in the closure member closed position and a projection depending from the closure member top wall and engaging the inside face of said latch arms in said closure member closed position.

* * * * *